US006512429B2

(12) United States Patent
Hiratsuka et al.

(10) Patent No.: US 6,512,429 B2
(45) Date of Patent: Jan. 28, 2003

(54) DIELECTRIC FILTER, TRANSMISSION/ RECEPTION SHARING DEVICE, AND COMMUNICATION DEVICE

(75) Inventors: Toshiro Hiratsuka, Nagao-Kakyo (JP); Tomiya Sonoda, Muko (JP); Shigeyuki Mikami, Nagaokakyo (JP); Kiyoshi Kanagawa, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/928,284

(22) Filed: Aug. 10, 2001

(65) Prior Publication Data

US 2002/0017968 A1 Feb. 14, 2002

Related U.S. Application Data

(62) Division of application No. 09/335,346, filed on Jun. 17, 1999, now abandoned.

(30) Foreign Application Priority Data

Jun. 18, 1998 (JP) ..... 10-171174

(51) Int. Cl.[7] ..... H01P 1/213; H01P 1/20

(52) U.S. Cl. ..... 333/134; 333/202; 333/219.1

(58) Field of Search ..... 333/202, 219.1, 333/134

(56) References Cited

U.S. PATENT DOCUMENTS 4,740,765 A * 4/1988 Ishikawa et al. ..... 333/206

FOREIGN PATENT DOCUMENTS

| | | |
|---|---|---|
| JP | 51-134548 | 11/1976 |
| JP | 8-195603 | 7/1996 |
| JP | 409246820 A * | 9/1997 |

OTHER PUBLICATIONS

Japanese Examination Report dated Jul. 2, 2002, along with the English translation.

* cited by examiner

*Primary Examiner*—Robert Pascal
*Assistant Examiner*—Stephen E. Jones
(74) *Attorney, Agent, or Firm*—Dickstein, Shapiro, Morin & Oshinsky, LLP.

(57) ABSTRACT

Lines for input/output to be respectively coupled with two resonators formed on a dielectric plate, and a coupling line for polarization to be respectively coupled with two resonators which may be separated from each other by one or more other stages to achieve the jump-coupling between the resonators, are respectively formed on an substrate in order to solve problems including the increase in dead space, the increase in the machining and assembly processes for forming a coupling loop, and the reproductivity of characteristics which are caused by using a cable for jump-coupling in polarizing a dielectric filter of planar circuit type.

8 Claims, 18 Drawing Sheets

DIELECTRIC FILTER, TRANSMISSION/ RECEPTION SHARING DEVICE, AND COMMUNICATION DEVICE

This is a divisional of U.S. patent application Ser. No. 09/335,346, filed Jun. 17, 1999, abandoned, in the name of Toshiro Hiratsuka, Tomiya Sonoda, Shigeyuki Mikami and Kiyoshi Kanagawa, titled DIELECTRIC FILTER TRANSMISSION/RECEPTION SHARING DEVICE AND COMMUNICATION DEVICE, now abandoned.

BACKGROUND OF THE INVENTION

1. Field of the Invention

The present invention relates to a dielectric filter in which a resonator is formed on a dielectric plate, a transmission/reception sharing device and a communication device using the dielectric filter.

2. Description of the Related Art

A bandpass filter having a plurality of resonators in series has been used in a communication device.

To obtain large attenuation above and below a pass band, the so called "jump-coupling method" has been utilized. In accordance with the method, a pair of resonators are directly electromagnetically coupled to each other jumping over another resonator therebetween. By causing the jump-coupling, a notch or pole appears outside the pass band On the other hand, a planar-circuit type dielectric filter is expected to be widely used in a wireless LAN, a portable visual telephone and a next generation satellite broadcasting system. These applications use sub-millimeter waves. This type of filter is described in Japanese Patent Application No. 9-103017. It should be noted that the Japanese application was not laid-open to the public at the time of filing Japanese Patent Application No. 10-171174 on which this case is based. Thus, the reference is provided as background information to show the state of the art only. The citation of the reference is not to be construed as an admission that it constitutes prior art.

The application No. JP-A-9-103017 discloses a dielectric filter in which an electrode is formed on each side of a dielectric plate to constitute a resonator at the prescribed position of the dielectric plate, a micro-strip line is formed on a substrate, and the micro-strip line is coupled with the dielectric resonator.

This dielectric filter is extremely advantageous, being compact in size, easy to manufacture, and capable of easily obtaining the desired characteristics.

The above-mentioned jump-coupling is also effective to secure the large attenuation on the high-frequency side or the low-frequency side of its pass band of the planar circuit type dielectric filter.

An example is illustrated in FIG. 19 and FIG. 20, where the above-mentioned filter device in which a part of the dielectric plate is used as the resonator and a structure for causing jump-coupling between the resonators is implemented. FIG. 19 is an assembly view in which electrodes 2, 3 having electrode-free parts of the same shape opposite to each other across a dielectric plate are provided on each side of the dielectric plate 1 to constitute a third-order filter. Numerals 4*a*, 4*b* and 4*c* denote electrode-free parts on the upper surface thereof. Numeral 6 denotes a substrate on which a microstrip line to be coupled with the resonator is formed, and a basic part of the dielectric filter is constituted by successively laminating a package 8, the dielectric plate 1, an electromagnetic wave absorption body 11 and a shield 12 comprising a metallic plate thereon. In order to cause a pole outside the pass band, a semi-rigid cable in which a coupling loop is formed on each end is provided on the shield 12 in order to cause jump-coupling between a first-stage resonator and a third-stage resonator as illustrated in the figures.

FIG. 20 illustrates a sectional view of the abovementioned dielectric filter. The filter device has a higher profile because of the diameter of the semi-rigid cable. Thus, a dead space may be produced when the filter device is installed in electronic equipment. Also, a separate semi-rigid cable is necessary, the assembly process requires machining and soldering to form the coupling loop, and the cost is increased as a whole. Further, because the position of an attenuation pole is largely changed depending on the direction, length, etc., of the coupling loop, it is relatively difficult to adjust the position of the cable to obtain a desired filter characteristic.

SUMMARY OF THE INVENTION

The present invention provides a dielectric filter in which the above-mentioned problems caused by using separate parts such as a semi-rigid cable are solved, and a transmission/reception sharing device and communication device using the dielectric filter.

In the present invention, an electrode having electrode-free parts opposite to each other, on opposite sides of a dielectric plate, is provided on each side of the dielectric plate, an area between the electrode electrode-free parts is a resonator, and a plurality of stages of resonators in which adjacent resonators are successively coupled with each other, are provided on the dielectric plate. A coupling line for polarization, which directly couples two resonators by respectively coupling the line with the two resonators which may be separated from each other by one or more other stages among a plurality of resonators, is provided on a substrate separated from the dielectric plate by a prescribed distance. In such a structure, the coupling line for polarization is provided on the substrate, and no parts such as the semi-rigid cable are projected outside, and the device is not increased in size.

In the present invention, a line for signal input/output to be coupled with prescribed resonators is provided on the substrate provided with the coupling line for causing a pole. This structure dispenses with a special substrate on which a coupling line for causing a pole is provided in addition to a substrate on which the line for signal input/output is provided.

The substrate provided with the coupling line is used as a shield cover by forming an electrode on approximately the whole surface opposite to a surface on which the coupling line for polarization is formed. The structure dispenses with a single shield cover, and also dispenses with a substrate exclusively used for forming the coupling line for polarization.

In the present invention, an electrode having openings of approximately same shape which are opposite to each other, on opposite sides of a dielectric plate, is provided on each side of the dielectric plate, an area between the openings is a resonator, and a plurality of stages of resonators in which adjacent resonators are successively coupled with each other, are provided on the dielectric plate. A coupling line for polarization, which directly couples two resonators, e.g., through a slot line, by respectively coupling the line with the two resonators which may be separated from each other by one or more other stages among a plurality of resonators, is provided on the substrate. Such a structure dispenses with a substrate for forming the coupling line for polarization, and simultaneous patterning is realized in forming resonators.

Also, in the present invention, a transmission/reception sharing device is constituted by providing either of the above-mentioned dielectric filters as a transmission filter, a reception filter, or both filters.

Further, in the present invention, a communication device is constituted by providing the dielectric filter in a high-frequency circuit part, or in a transmission/reception sharing device such as, for example, an antenna. Other features and advantages of the present invention will become apparent from the following description of the invention which refers to the accompanying drawings.

DESCRIPTION OF THE PREFERRED EMBODIMENTS

Figure 1:
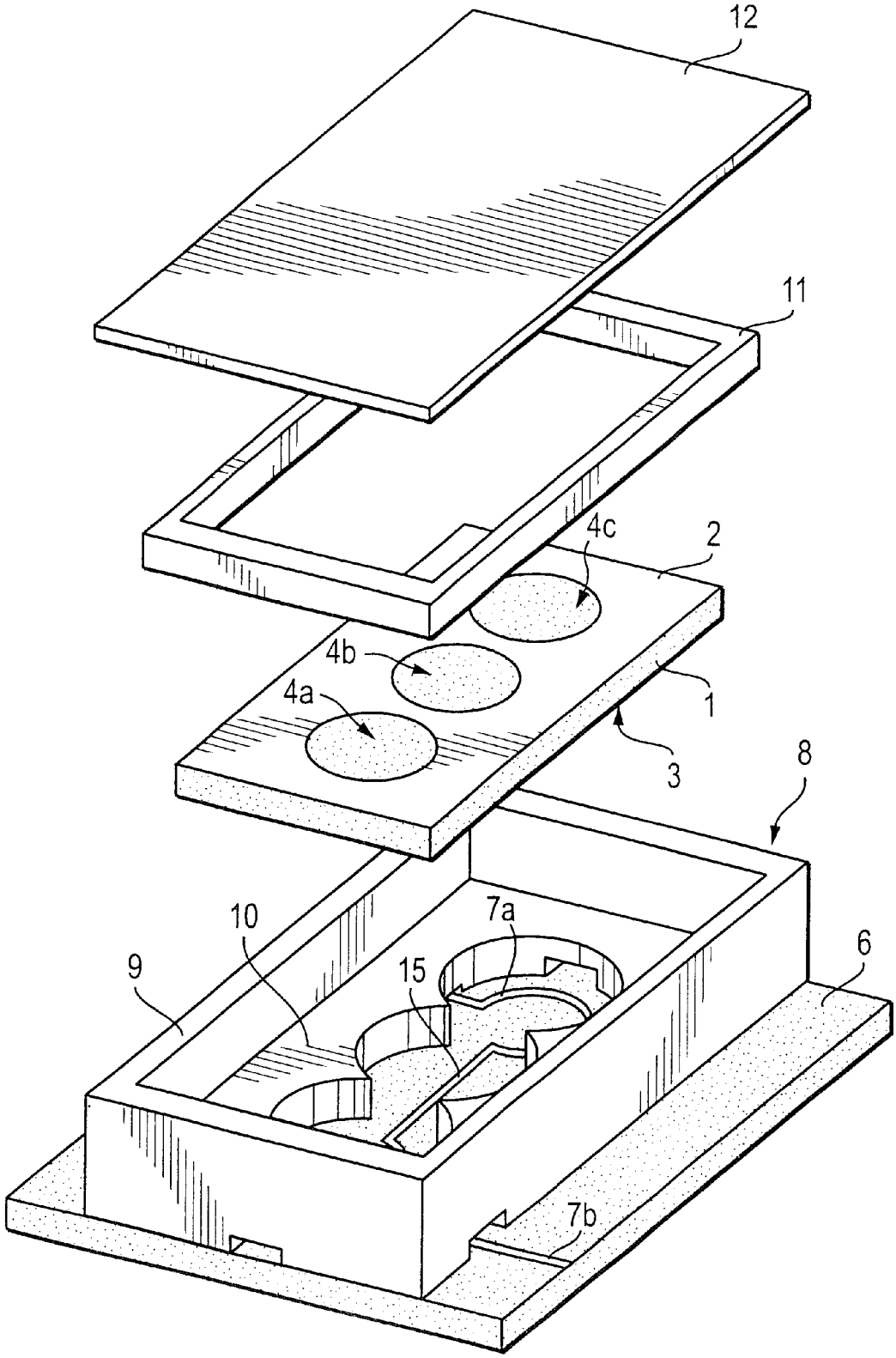
FIG. 1 is an assembly view of a dielectric filter according to a first embodiment.

The constitution of a dielectric filter according to a first embodiment of the present invention is described referring to FIG. 1 through FIG. 3.

FIG. 1 is an assembly view of a dielectric filter. A three-order filter is constituted by using electrodes 2, 3 having openings opposing to each other across the dielectric plate 1 on each side of the dielectric plate 1. Reference numerals 4*a*, 4*b* and 4*c* denote openings in the electrodes 2. Numeral 6 denotes a substrate on which input/output lines 7*a*, 7*b* and a coupling line 15 to be coupled with a dielectric resonator are formed. Because grounding electrodes are formed approximately on the whole area of the lower side of the substrate, the input/output lines 7*a*, 7*b* and the coupling line 15 constitute a micro-strip line, respectively. The substrate 6 is a printed circuit board of 3.5 in dielectric constant and 0.3 mm in thickness, the line width of the input/output lines 7*a*, 7*b* is 0.62 mm, and their characteristic impedance is 50 Q. The line width of the coupling line 15 is 0.2 mm. 8 denotes a package adhered to the substrate 6, which is provided with a frame 9 and a resonance space limiting part 10. 11 denotes a radio wave absorber, which absorbs the spurious wave of the parallel plate mode or the like to be generated between the electrodes 2 and 3 of the dielectric plate. 12 denotes a cover formed of a metallic sheet, which is joined to an upper surface of the frame part 9 of the package 8 by soldering or the like.

Figure 2A:
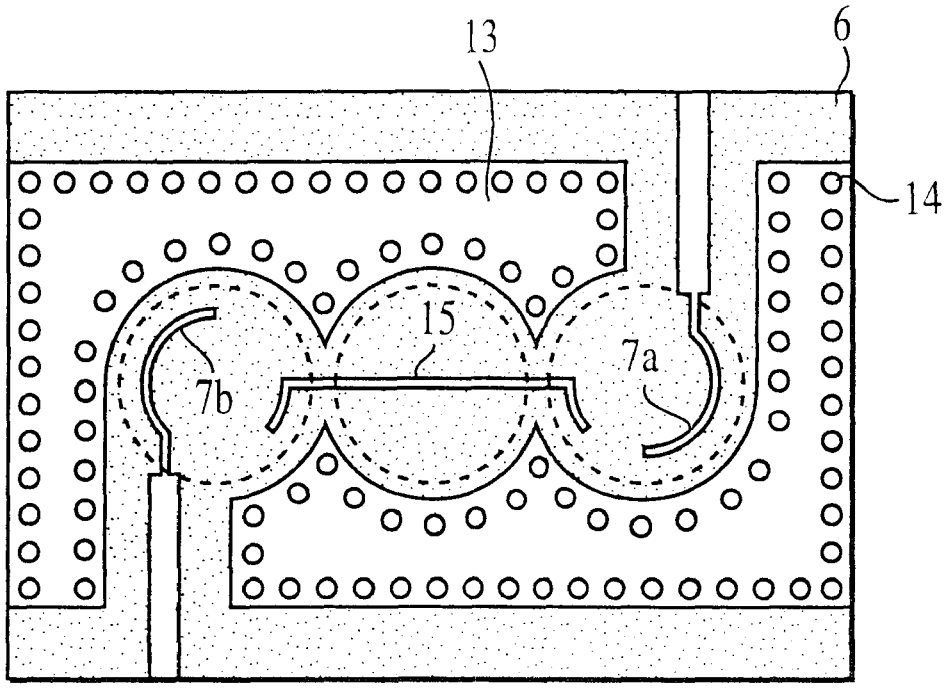
FIG. 2 is a top plan view of a substrate of the dielectric filter.
Figure 2B:
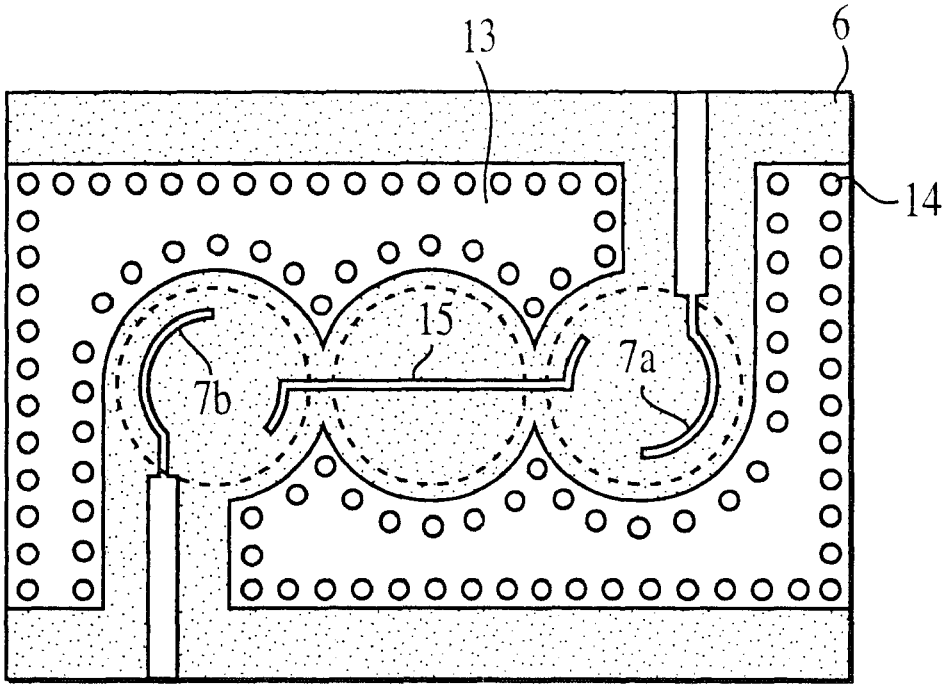

FIG. 2 is a top plan view of the substrate 6 and illustrates two different examples. In both examples of FIG. 2A and FIG. 2B, the lines 7*a*, 7*b* for input/output are formed on the upper surface of the substrate 6 at the coupling position with a first-stage resonator and a third-stage resonator. Grounding electrodes 13 are formed in an area which is not used for the resonance space of three resonators. The grounding electrodes are formed over the whole area of the lower side of the substrate 6, and the grounding electrodes on the lower side are electrically connected to the grounding electrodes on the upper side through a plurality of through holes 14. 15 denotes a coupling line for polarization, and each end of which is arranged at the coupling position with the third-stage resonator. However, the extending direction of each end of the coupling line for polarization is different between FIG. 2A and FIG. 2B.

In FIG. 2A, three resonators resonate in the TE010 mode, and adjacent resonators are magnetically coupled, i.e., inductively coupled with each other. Regarding the direction of the electric field at the instant in the TE010 mode of these three resonators, for example, the first-stage resonator has clockwise polarity, the second-stage resonator has counter-clockwise polarity, and the third-stage resonator has clockwise polarity. Thus, the direction of the current flowing in the coupling line 15 is the same. The line length of the coupling line 15 is one half ($\lambda g/2$) of one wavelength (hereinafter, referred to as $\lambda g$) on the line at the resonance frequency of the resonator. The coupling line 15 is magnetically coupled, i.e., inductively coupled with the first-stage and the third-stage resonators, respectively, and because the line length of the coupling line 15 is $\lambda g/2$, the phase difference at the coupling line for polarization becomes $\pi$, and the first-stage resonator is capacitively coupled with the third-stage resonator. Thus, two resonators which may be separated from each other by one stage are jump-coupled through capacitive coupling.

In the example in FIG. 2B, the coupling line 15 is magnetically coupled, i.e., inductively coupled with the first-stage resonator and the third-stage resonator, respectively, but the extending direction at each end of the coupling line 15 is opposite to each other, and the phase difference on the coupling line 15 is $\pi$, and the first-stage resonator is inductively coupled with the third-stage resonator. Thus, two resonators which may be separated from each other by one stage are jump-coupled through the inductive coupling.

Figure 3A:
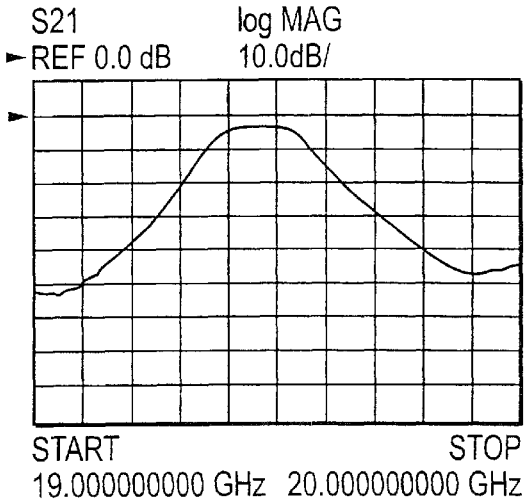
FIG. 3 is a characteristic graph of the dielectric filter.
Figure 3B:
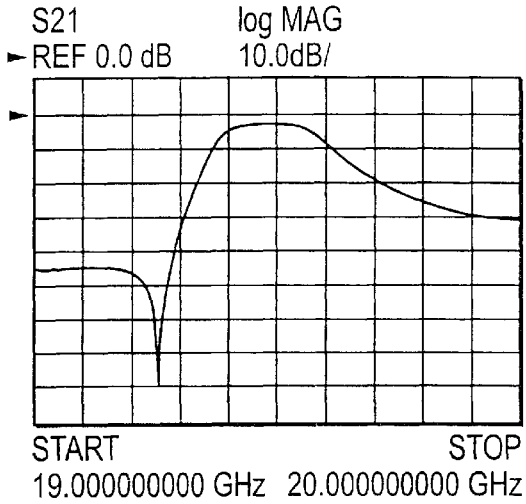
Figure 3C:
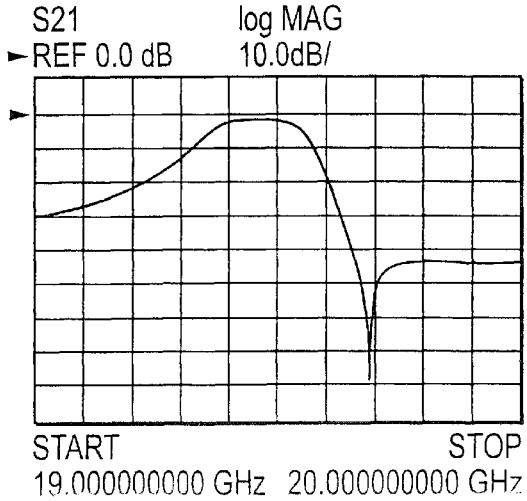

FIG. 3A illustrates the passing characteristic of a dielectric filter having no coupling line for polarization, FIG. 3B illustrates the passing characteristic of the dielectric filter shown in FIG. 2A, and FIG. 3C illustrates the passing characteristic of the dielectric filter shown in FIG. 2B, respectively. As illustrated in FIG. 2A, an attenuation pole is generated on the low-frequency side of the passing band by achieving the inductive coupling between adjacent resonators, and achieving the jump-coupling of two resonators which may be separated from each other by one stage through the capacitive coupling. On the contrary, as illustrated in FIG. 2B, an attenuation pole is generated on the high-frequency side of the passing band by achieving the inductive coupling between adjacent resonators, and achieving the jump-coupling of two resonators which may be separated from each other by one stage through the inductive coupling.

Large attenuation on the low-frequency side or the high-frequency side of the passing band can thus be secured by forming an attenuation pole on the low-frequency side or the high-frequency side of the passing band.

Figure 4:
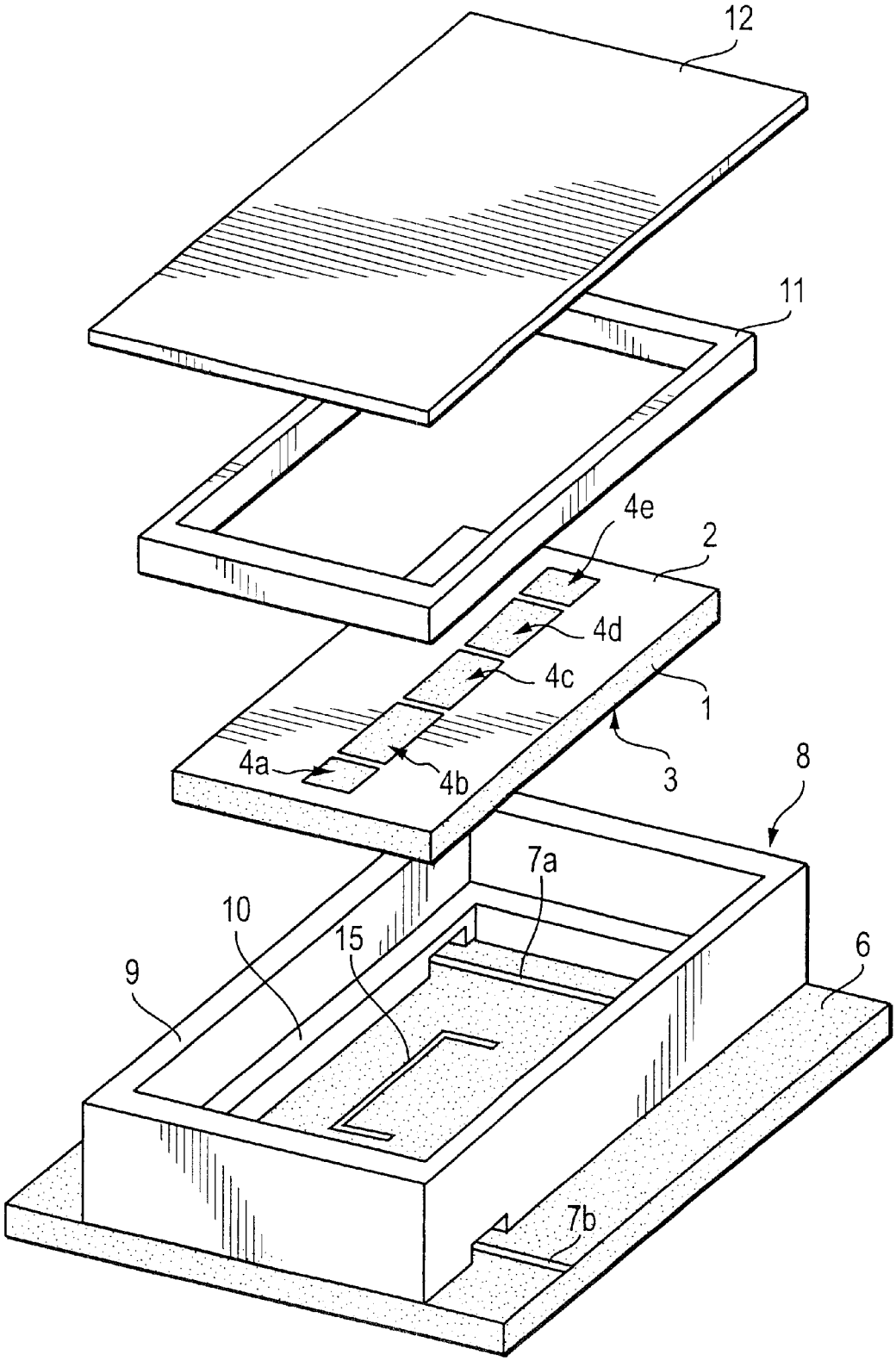
FIG. 4 is an assembly view of a dielectric filter according to a second embodiment.
Figure 5A:
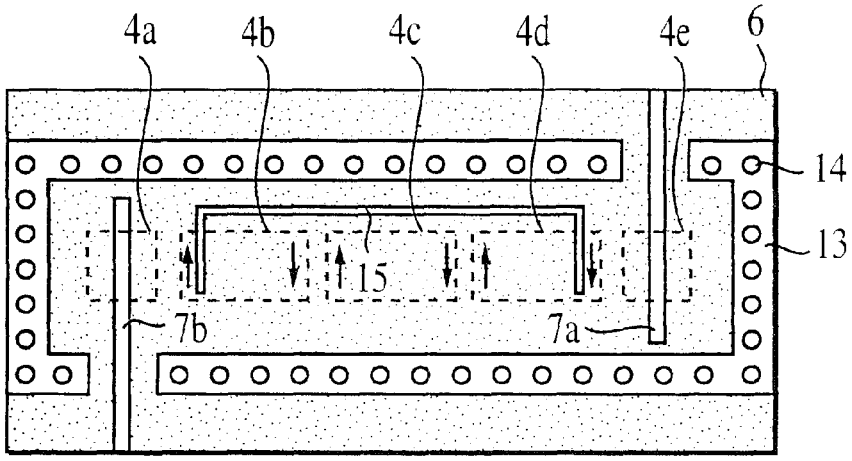
FIG. 5 is a top plan view of a substrate of the dielectric filter.
Figure 5B:
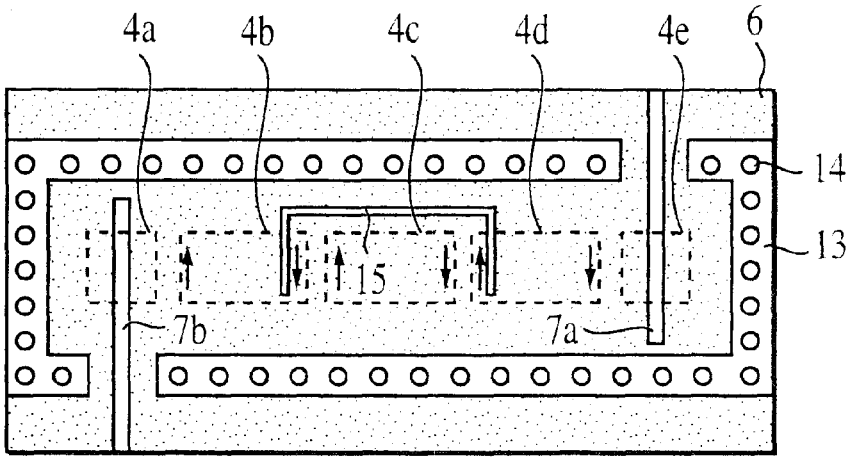
Figure 5C:
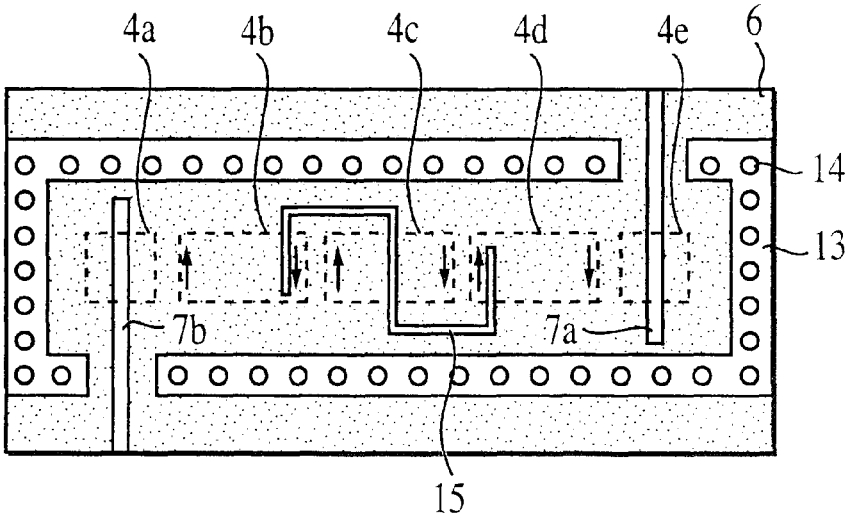
Figure 6A:
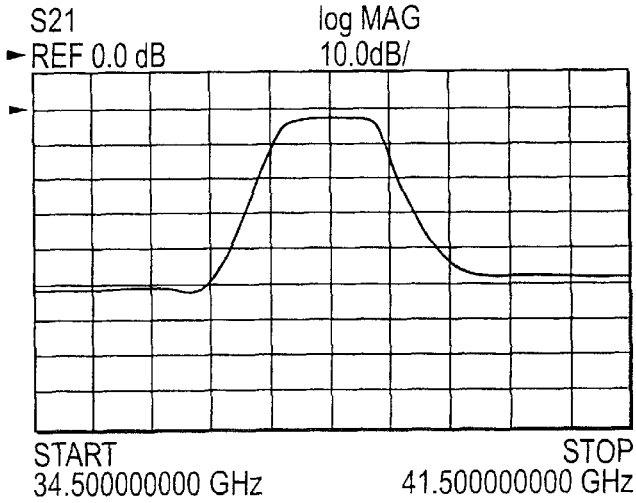
FIG. 6 is a characteristic graph of the dielectric filter.

Next, the constitution of a dielectric filter according to a second embodiment is described referring to FIG. 4 through FIG. 6.

FIG. 4 is a whole assembly view. Different from the example illustrated in FIG. 1, electrode non-forming parts 4*a*, 4*b*, 4*c*, 4*d* and 4*e* of electrodes 2, 3 provided on each side of a dielectric plate 1 are rectangular in shape in this example. An substrate 6 is 3.5 mm in dielectric constant and 0.2 mm in thickness, lines 7*a*, 7*b* for input/output are micro-strip lines of 0.4 mm in line width and 50 Ω in characteristic impedance. A coupling line 15 is a micro-strip line of 0.1 mm in line width.

The dielectric constant of the dielectric plate 1 is 24, and the tanδ is 2.9×10−4 (at 10 GHz), and the resonance frequency of a formed resonator is 38 GHz. The wavelength λg on the coupling line for polarization at the frequency of 38 GHz is approximately 5.0 mm.

FIG. 5 is a top plan view of the substrate 6, illustrating three different examples. The lines 7*a* and 7*b* for input/output are formed on the upper surface of the substrate 6, and respectively and magnetically coupled with an initial-stage resonator at a part of an electrode non-forming part 4*e* and with a final-stage resonator at a part of an electrode non-forming part 4*a* which are formed on the dielectric filter 1 illustrated in FIG. 4. A coupling line 15 to jump-couple a second-stage resonator with a fourth-stage resonator is also formed. In addition, a grounding electrode 13 is formed on a part to achieve the conductive adhesion of a package 8, and electrically connected to a grounding electrode approximately over the whole area of the lower side via through holes 14.

In this embodiment, the basic mode of the rectangular slot mode is used for the first-stage resonator and a fifth-stage resonator, while the double mode (second harmonic) of the rectangular slot mode is used in second-stage, third-stage and fourth-stage resonator.

The arrows in FIG. 5 indicate the direction of the electric field distribution. Adjacent resonators are magnetically coupled, i.e., inductively coupled. In an example of FIG. 5A, the line length of the coupling line 15 is 7.5 mm, i.e., 1.5 λg (electric length 3π=π), and the phase is inverted on the coupling line 15. The coupling line 15 is inductively coupled with the second-stage resonator and the fourth-stage resonator, respectively, and the second-stage resonator is jump-coupled with the fourth-stage resonator through capacitive coupling because the phase is inverted on the coupling line 15.

Figure 6B:
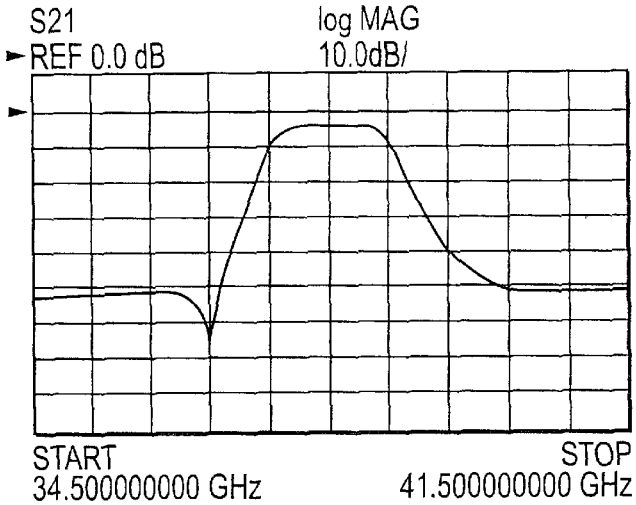

FIG. 6 shows the passing characteristic of the abovementioned dielectric filter. As illustrated in FIG. 5A, an attenuation pole is generated on the low-frequency side of the passing band as illustrated in FIG. 6B by inductively coupling adjacent resonators with each other, and jump-coupling two resonators which may be separated from each other by one stage through the capacitive coupling.

In an example illustrated in FIG. 5B, the line length of the coupling line 15 is 5.0 mm, i.e., λg (electric length 2π=0), and the phase is same at each end of the coupling line 15. Because the coupling line 15 is inductively coupled with the second-stage resonator and the fourth-stage resonator, respectively, the second-stage resonator is jump-coupled with the fourth-stage resonator through inductive coupling.

Figure 6C:
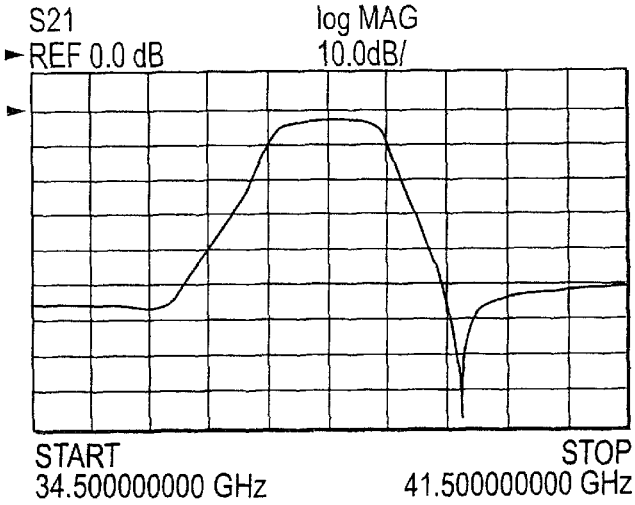

In an example illustrated in FIG. 5C, the line length of the coupling line 15 is 7.5 mm, i.e., 1.5 λg (electric length 3π=π). However, the respective directions of the current flowing in the coupling line 15 at its two ends become opposite to each other, and the phase is eventually the same, and the second-stage resonator is jump-coupled with the fourth-stage resonator through the inductive coupling. An attenuation pole is thus generated on the high-frequency side of the passing band as illustrated in FIG. 6C by inductively coupling adjacent resonators, and jump-coupling two resonators which may be separated from each other by one stage through the inductive coupling.

Figure 7:
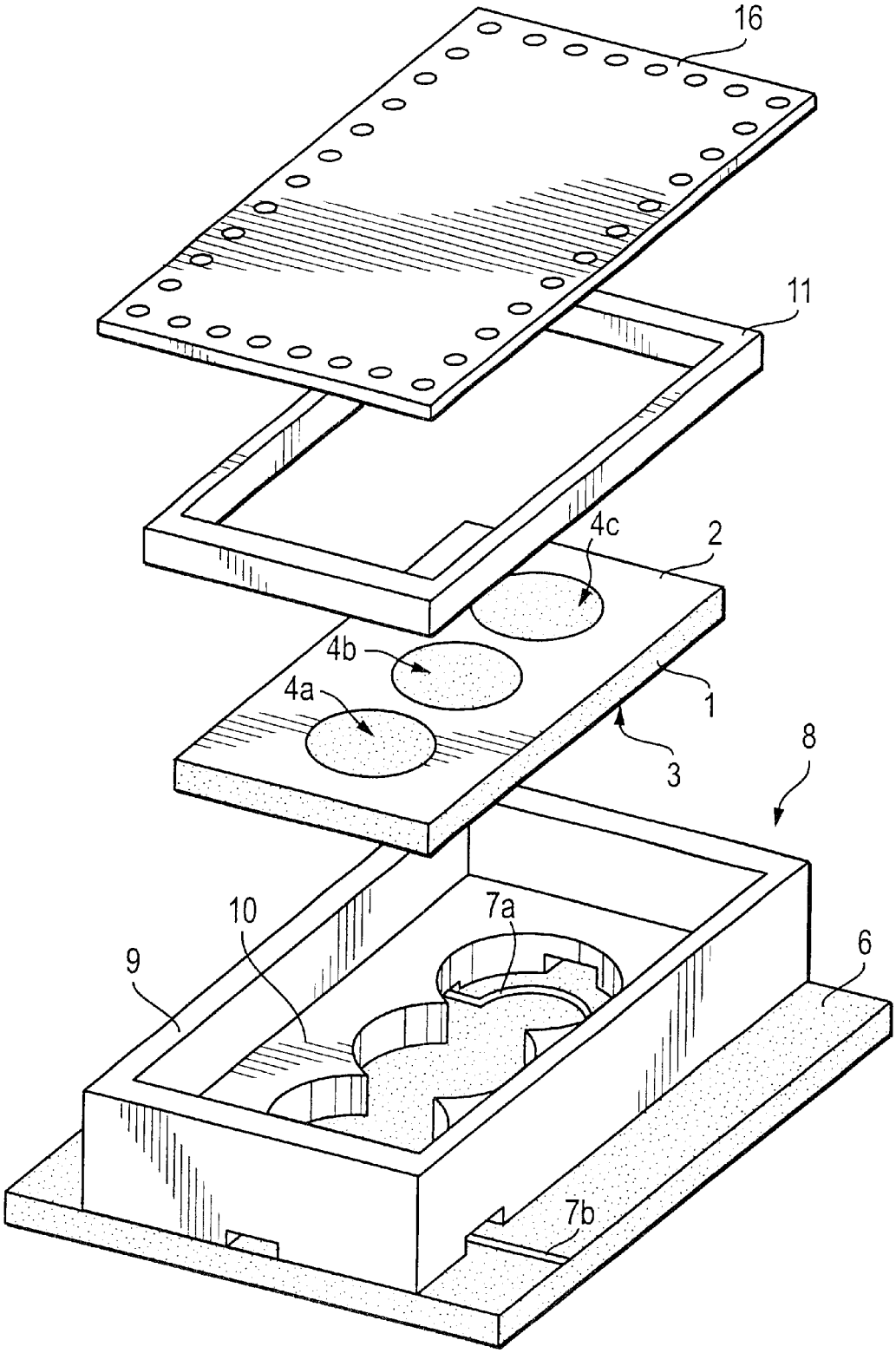
FIG. 7 is an assembly view of a dielectric filter according to a third embodiment.
Figure 8:
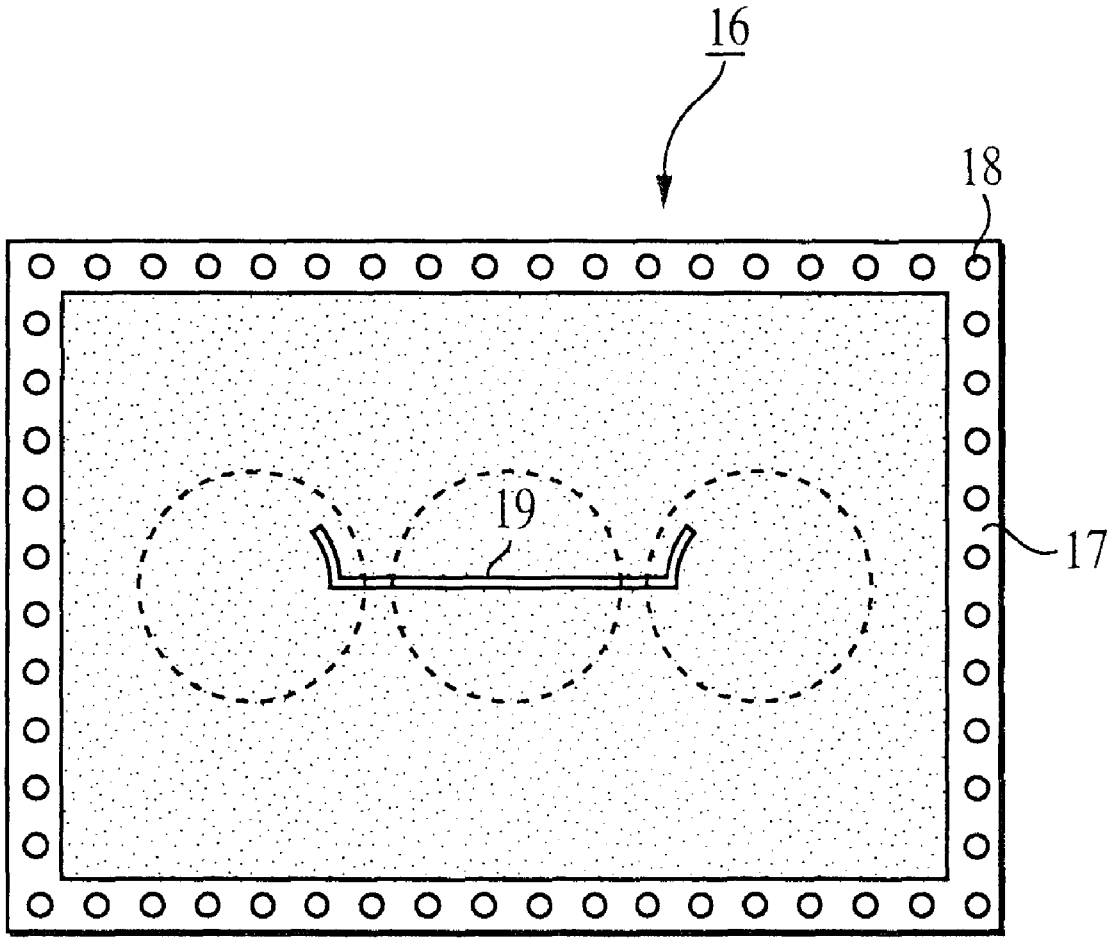
FIG. 8 is a bottom plan view of a cover of the dielectric filter.

FIG. 7 and FIG. 8 are the constitution of a dielectric filter according to a third embodiment. FIG. 7 is an assembly view, and FIG. 8 is a bottom plan view of a cover. In the first and second embodiments, the coupling line for polarization is formed together with the line for input/output on the substrate, but in an example illustrated in FIG. 7, a cover 16 is a printed circuit board, and a coupling line 19 for polarization is formed on its lower side (a surface opposite to a dielectric plate 2). Grounding electrodes 17 are formed on the whole area of the upper side (outer surface) of the cover 16 and a peripheral part of the lower side, and the grounding electrodes on both sides are electrically connected via through holes 18. The coupling line 19 for polarization is simultaneously patterned in forming these grounding electrodes.

In this example, an attenuation pole is formed on the low-frequency side of the passing band by setting the line length of the coupling line 19 for polarization to be λg/2 (electric length π), and jump-coupling a first-stage resonator with a third-stage resonator through the capacity coupling.

Figure 9A:
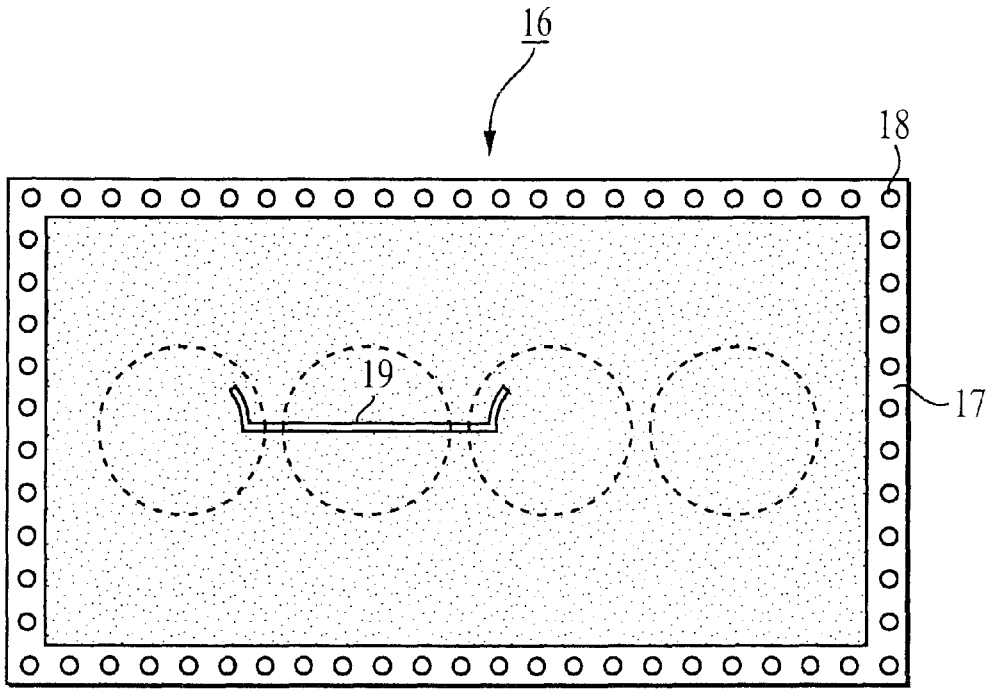
FIG. 9 is a bottom plan view of a cover and a top plan view of a substrate of a dielectric filter according to a fourth embodiment.
Figure 9B:
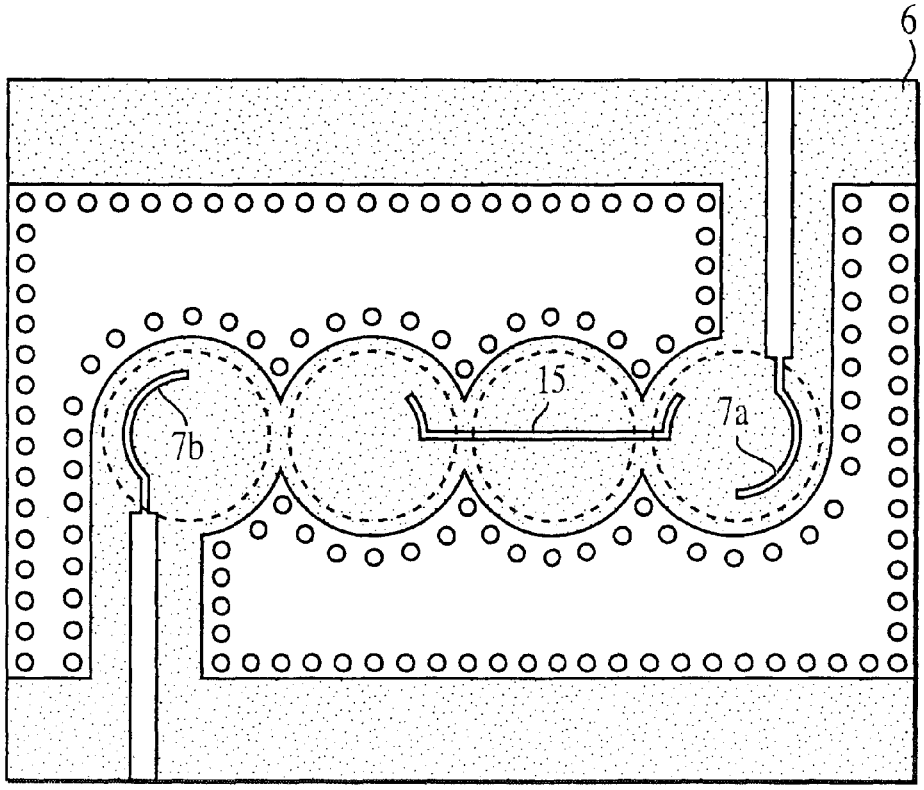
Figure 10A:
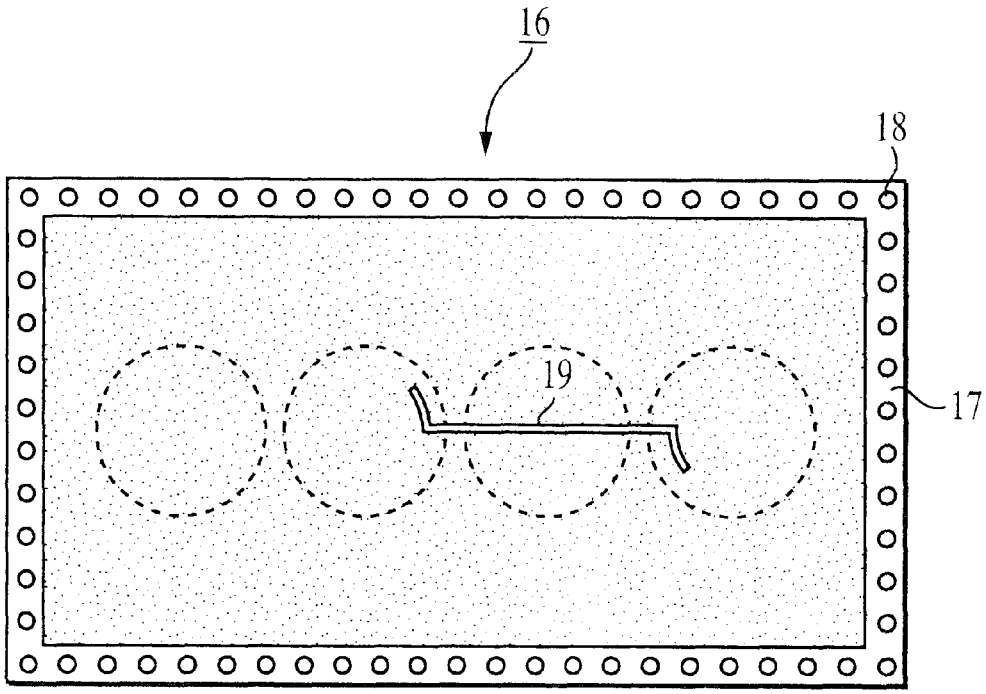
FIG. 10 is a bottom plan view of a cover and a top plan view of a substrate of another dielectric filter according to the fourth embodiment.
Figure 10B:
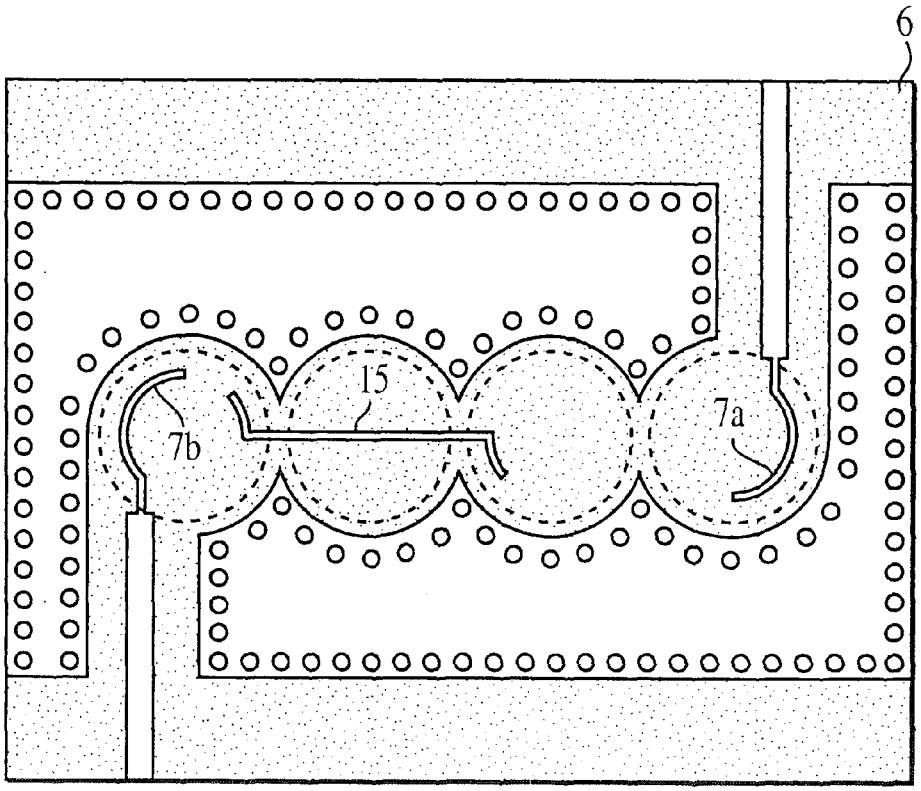
Figure 11A:
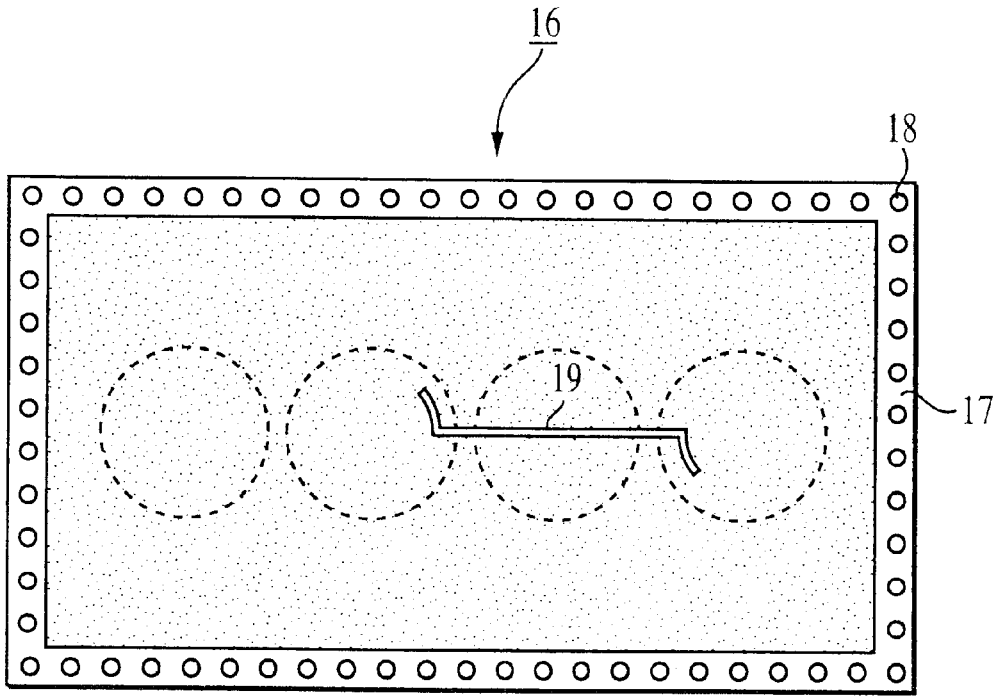
FIG. 11 is a bottom plan view of a cover and a top plan view of a substrate of still another dielectric filter according to the fourth embodiment.
Figure 11B:
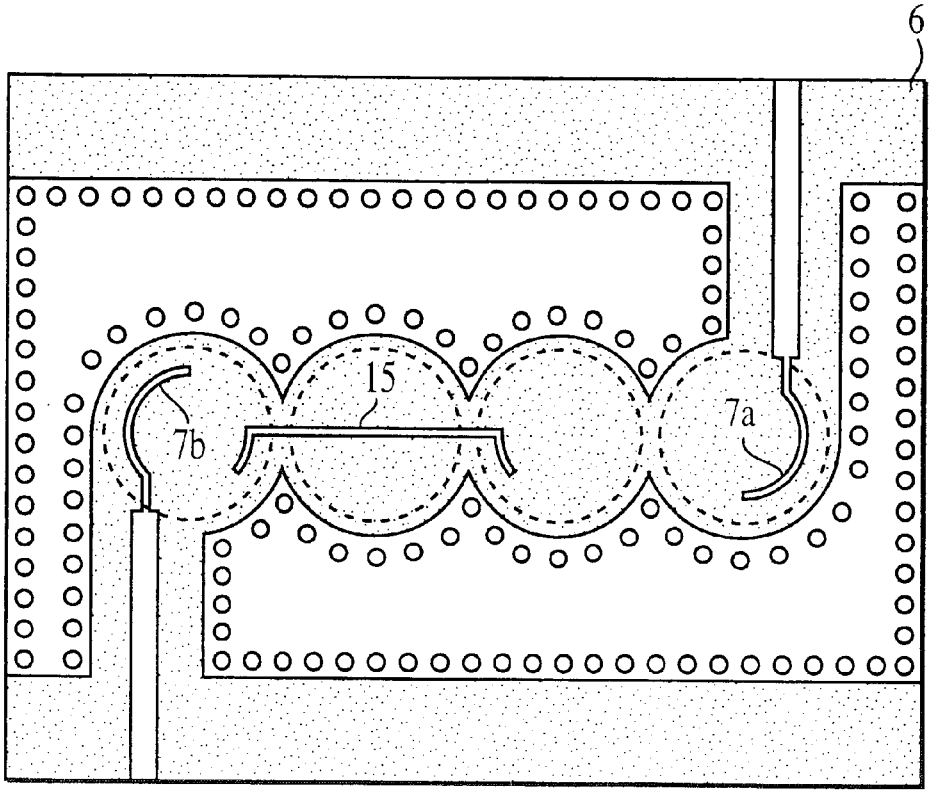

Next, the constitution of three dielectric filters according to a fourth embodiment is illustrated in FIG. 9 through FIG. 11. In these figures, FIGS. 9A, 10A and 11A show a lower side (inner surface) of a cover formed by a printed circuit board, and FIGS. 9B, 10B and 11B show a top plan view of an substrate. The basic constitution is similar to that shown in FIG. 2, FIG. 7 and FIG. 8, a coupling line 19 for polarization of λg/2 in line length is formed at the prescribed position of the lower side of a cover 16, and lines 7*a* and 7*b* for input/output and a coupling line 15 of λg/2 in line length are formed at the prescribed position on the upper surface of an substrate 6. Four resonators are arranged on a dielectric plate. The dotted line in the figure indicates the position of four resonators.

In an example illustrated in FIG. 9, the coupling 19 for polarization on the lower side of the cover 16 is formed to jumpcouple a first-stage resonator with a third-stage resonator through the capacitive coupling. The coupling line 15 on the substrate 6 side is formed to jump-couple a second-stage resonator with a fourth-stage resonator through the capacitive coupling.

In an example illustrated in FIG. 10, the coupling line 19 for polarization on the lower side of the cover 16 is formed at the position to jump-couple the second-stage resonator with the fourth-stage resonator through the inductive coupling, and the coupling line 15 on the upper side of the substrate 6 is formed at the position to jump-couple the first-stage resonator with the third-stage resonator through the inductive coupling.

Similarly, in an example illustrated in FIG. 11, the coupling line 19 for polarization on the cover 16 is formed at the position to jump-couple the second-stage resonator with the fourth-stage resonator through the inductive coupling, and the coupling line 15 on the substrate 6 is formed at the position to jump-couple the first-stage resonator with the third-stage resonator through the capacitive coupling.

Figure 12A:
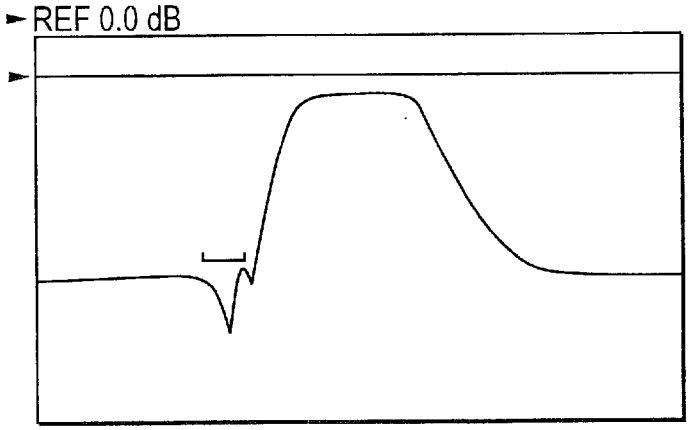
FIG. 12 is a characteristic graph of the dielectric filters illustrated in FIG. 9 through FIG. 11.
Figure 12B:
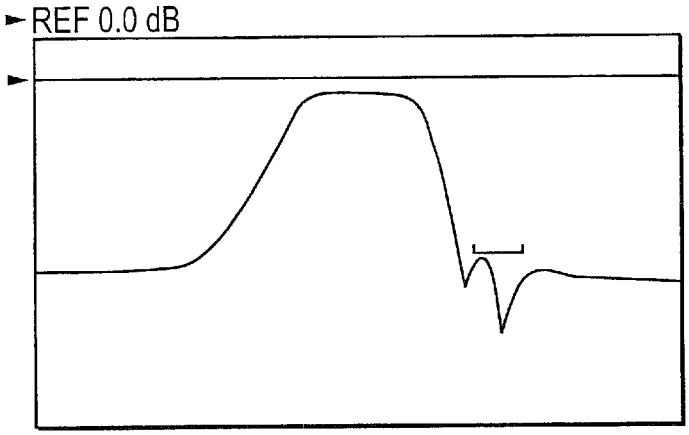
Figure 12C:
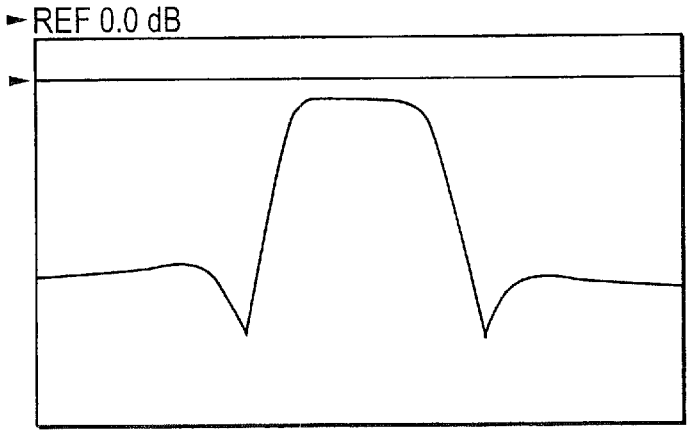

FIGS. 12A–12C indicate the passing characteristics of three dielectric filters illustrated in FIG. 9 through FIG. 11. As illustrated in FIG. 9, two attenuation poles are generated on the low-frequency side of the passing band as illustrated in FIG. 12A by providing two sets of jump-coupling circuits to respectively and inductively couple adjacent resonators, and to capacitively couple resonators which may be separated from each other by one stage. Similarly, two attenuation poles are generated on the high-frequency side of the passing band as illustrated in FIG. 12B by providing two sets of jump-coupling circuits to respectively and inductively couple adjacent resonators, and to inductively couple resonators which may be separated from each other by one stage. The prescribed attenuation can be secured over the prescribed band on the low-frequency side or the high-frequency side of the passing band by forming two attenuation poles at the positions adjacent to each other. The position (frequency) of two attenuation poles may be determined according to the band and the attenuation to be secured.

Further, as illustrated in FIG. 11, an attenuation pole can be respectively formed on the low-frequency side and the high-frequency side of the passing band as illustrated in FIG. 12C by inductively coupling adjacent resonators, jump-coupling two resonators which may be separated from each other by one stage on one side through capacitive coupling, and jump-coupling adjacent resonators which may be separated from each other by one stage on the other side through inductive coupling.

In the examples illustrated in FIG. 9 through FIG. 11, the line length of the coupling line for polarization is $\lambda g/2$, but an attenuation can be respectively formed both on the low-frequency side and on the high-frequency side of the passing band by providing the coupling line for polarization having the line length of e.g., $\lambda g$ on the substrate or the cover, and jump-coupling the first-stage resonator with the fourth-stage resonator through capacitive coupling.

Figure 13:
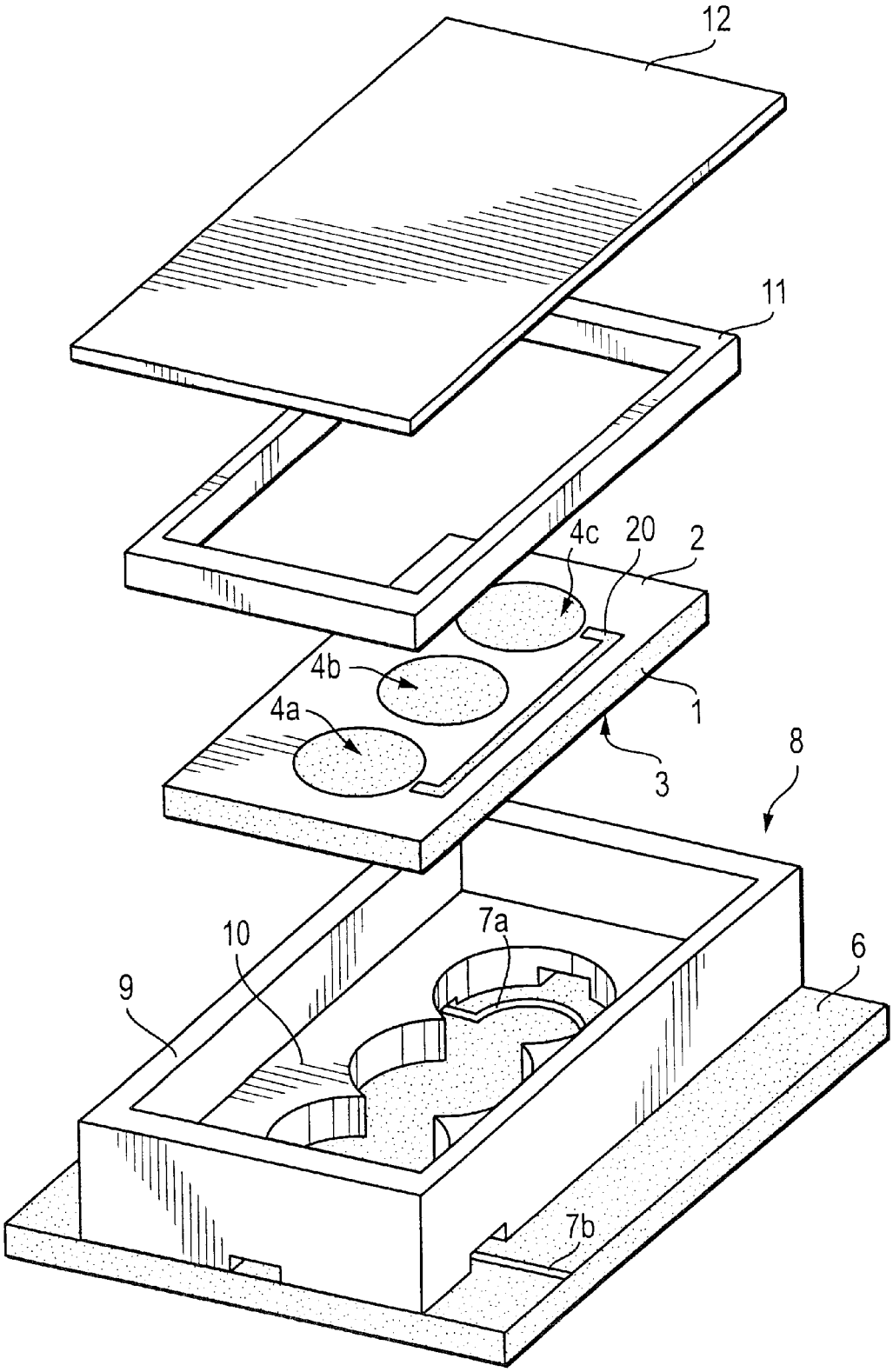
FIG. 13 is an assembly view of a dielectric filter according to a fifth embodiment.
Figure 14:
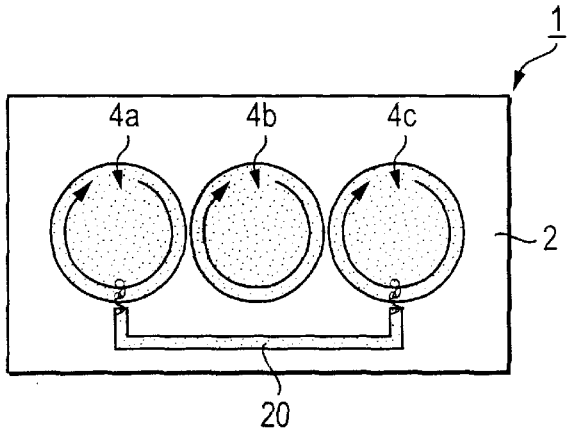
FIG. 14 is a top plan view of a dielectric plate of the dielectric filter.

Next, the constitution of a dielectric filter according to a fifth embodiment is illustrated in FIG. 13 and FIG. 14. FIG. 13 is an assembly view, and FIG. 14 is a top plan view of a dielectric plate. In this embodiment, a coupling line 20 for polarization is formed on a dielectric plate 1. Electrodes 2, 3 having electrode non-forming parts opposite to each other are formed on each side of the dielectric plate 1, and the coupling line 20 for polarization by the slot line is also formed thereon. The slot line is formed at the symmetrical position of the upper and lower sides of the dielectric plate 1, forming the slot line of vertically symmetrical type. Each end part of the coupling line 20 for polarization is brought close to electrode non-forming parts 4*a* and 4*c*, realizing the magnetic coupling therebetween. The dotted line in FIG. 14 indicates the condition of the magnetic coupling. In this structure, the first-stage resonator is jump-coupled with the third-stage resonator through the coupling line for polarization by the slot line.

Figure 15:
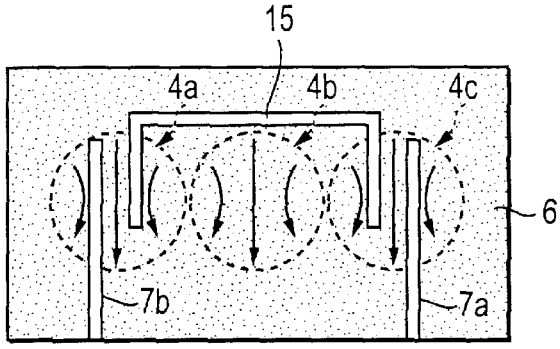
FIG. 15 is a top plan view of an substrate of a dielectric filter making use of the HE110 mode.

In each above-mentioned embodiment, other modes can be used similarly though the TE010 mode of the resonator is used in a structure where circular electrode non-forming parts are provided on the dielectric plate. For example, in a case where the HE110 mode is used, the constitution illustrated in FIG. 15 can be used. FIG. 15 is a plan view of an substrate. In FIG. 15, the dotted line indicates the position of three electrode non-forming parts formed on the dielectric plate arranged on an substrate 6. The arrows in the figure indicate the electric field distribution of the HE110 mode of the resonator by these electrode non-forming parts. Lines 7*a* and 7*b* for input/output by the micro-strip line and a coupling line 15 by the micro-strip line are formed on the substrate 6. As illustrated in the figure, when the coupling line 15 is arranged for the resonator art, one end of the coupling line 15 is magnetically coupled with the HE110 mode of the first-stage resonator, and the other end is magnetically coupled with the HE110 mode of the third-stage resonator.

Figure 16:
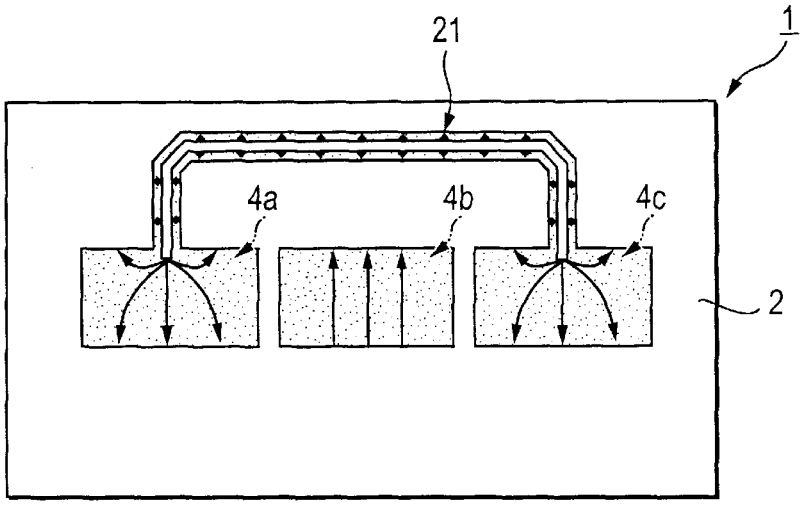
FIG. 16 is a top plan view of a dielectric plate of a dielectric filter where a coplanar line is a line for polarization.

Further, in an example illustrated in FIG. 14, a slot line is formed in a dielectric plate, but a coupling line for polarization formed on the dielectric plate provided with a resonator may be a coplanar line as illustrated in FIG. 16. FIG. 16 is a top plan view of the dielectric plate. An electrode 2 having electrode non-forming parts 4*a*, 4*b* and 4*c* of the same shape which are opposite to each other across a dielectric plate 1 is formed on each side of the dielectric plate 1, and at the same time, a coupling line 21 for polarization by the coplanar line of the same shape is formed on each side across the dielectric plate 1. The arrows in the figure show the condition of the electric field distribution. The resonators by the electrode non-forming parts 4*a*, 4*b* and 4*c* achieve the electric field coupling by respectively projecting each end part of a center conductor of a coplanar line 21 to a center part of the electrode non-forming parts 4*a* and 4*c* making use of the basic mode of the rectangular slot mode, respectively. A jump-coupling circuit can also be constituted by using the coplanar line.

Figure 17:
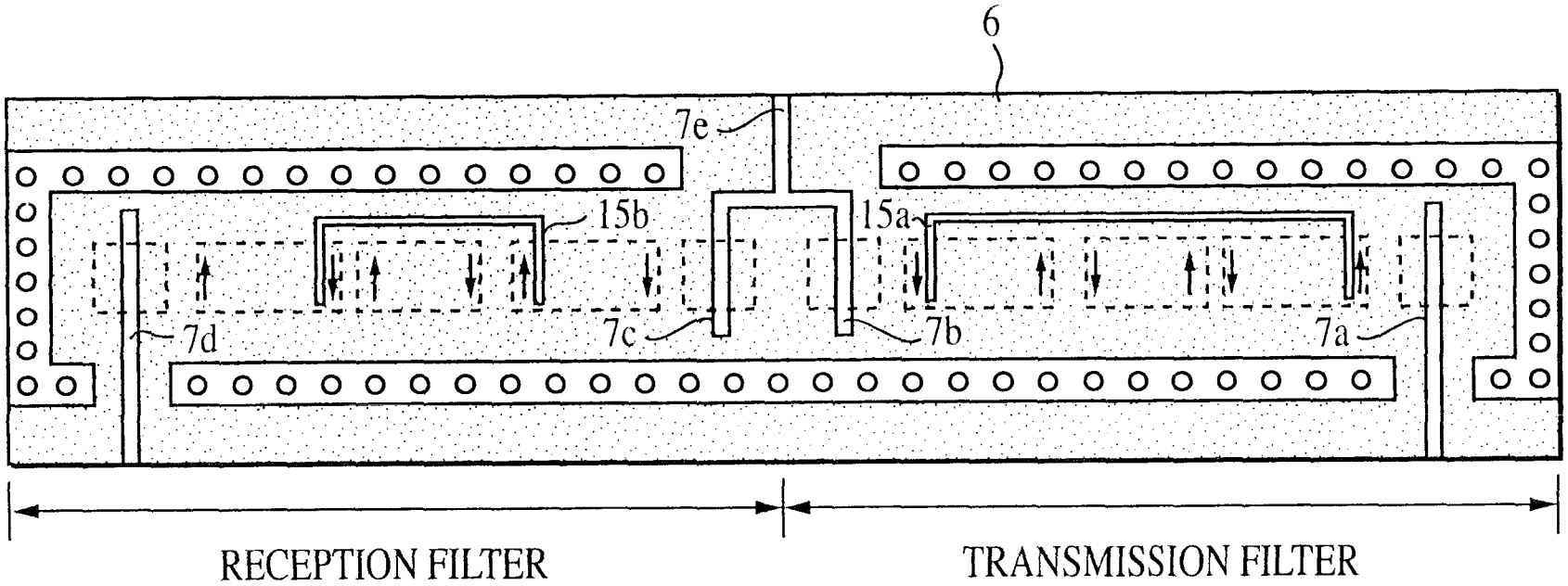
FIG. 17 is a top plan view of an substrate of a transmission/reception sharing device.

FIG. 17 is a view to illustrate the constitution of a transmission/reception sharing device. The basic constitution as a whole is similar to those illustrated in FIG. 4 and FIG. 5, except that a transmission filter and a reception filter are constituted in one device. That is, a structure illustrated in FIG. SA is applied to the transmission filter part, while a structure illustrated in FIG. 5B is applied to the reception filter part. The dotted line in the figure indicates the position of electrode nonforming parts of a dielectric plate arranged on an upper part of an substrate 6. Lines 7*a* and 7*b* for input/output are respectively coupled with a first-stage resonator and a fifth-stage resonator of the transmission filter, and lines 7*c* and 7*d* for input/output are respectively coupled with a first-stage resonator and a fifth-stage resonator of the reception filter part. A coupling line 15*a* for polarization is jump-coupled with a second-stage resonator and a fourth-stage resonator of the transmission filter through the capacitive coupling. A coupling line 15*b* for polarization is coupled with the second-stage resonator and the fourth-stage resonator of the reception filter through the inductive coupling.

The electric length from a branch point of a line 7*e* for input/output from the lines 7*b* and 7*c* to the equivalent short-circuit surface of the resonator at a final stage (the fifth stage) of the transmission filter is an odd-number times (electric length $\pi/2$) $\lambda g/4$ in terms of the wavelength on the line in the reception frequency band, and the electric length from the above-mentioned branch point to the equivalent short-circuit surface of the resonator of the initial stage (the first stage) of the reception filter is the odd-number times of $\lambda g/4$ (electric length $\pi/2$) on the line in the transmission frequency band. The transmission signal is thus branched from the reception signal.

A transmission/reception sharing device provided with a transmission filter having an attenuation pole on the low-frequency side of the passing band and a reception filter having an attenuation pole on the high-frequency side of the passing band, is thus obtained. Large coupling attenuation between a transmitter and a receiver can be secured by selecting the attenuation pole of the transmission filter to be the reception frequency band, and selecting the attenuation pole of the reception filter to be the transmission frequency band.

Figure 18:
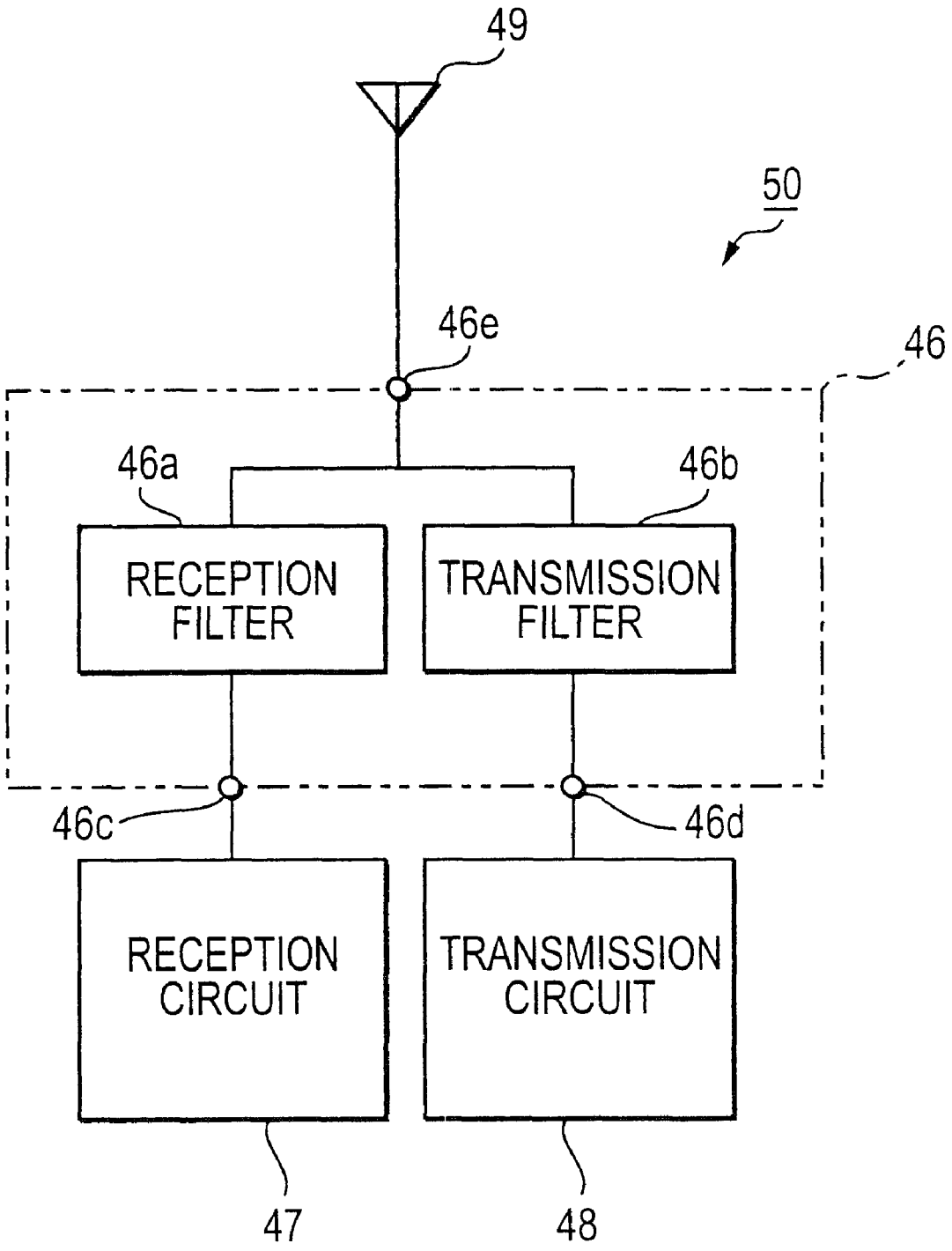
FIG. 18 is a block diagram to illustrate the constitution of a communication device.
Figure 19:
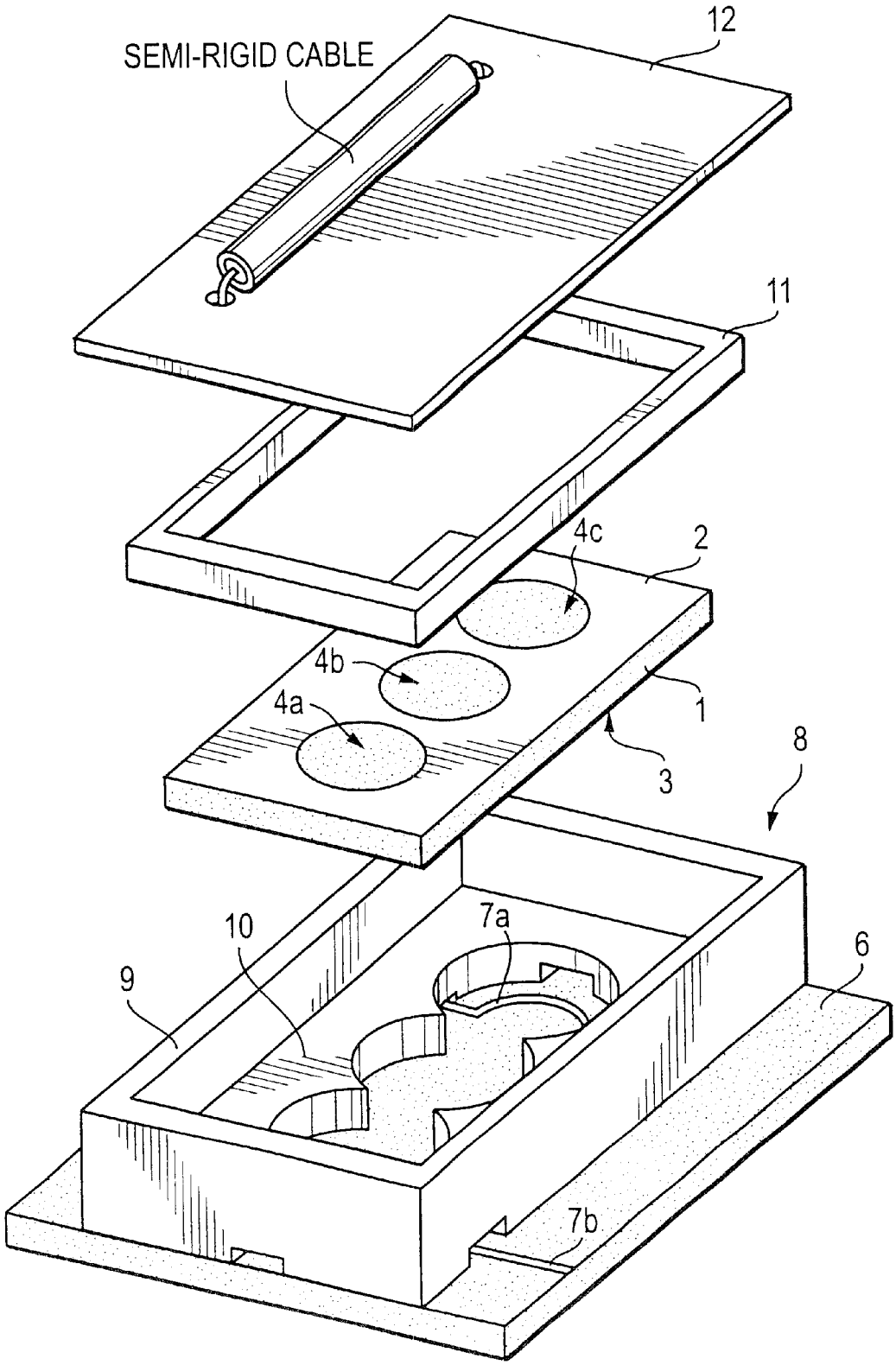
FIG. 19 PRIOR ART
FIG. 19 is an assembly view of a conventional dielectric filter.
Figure 20:
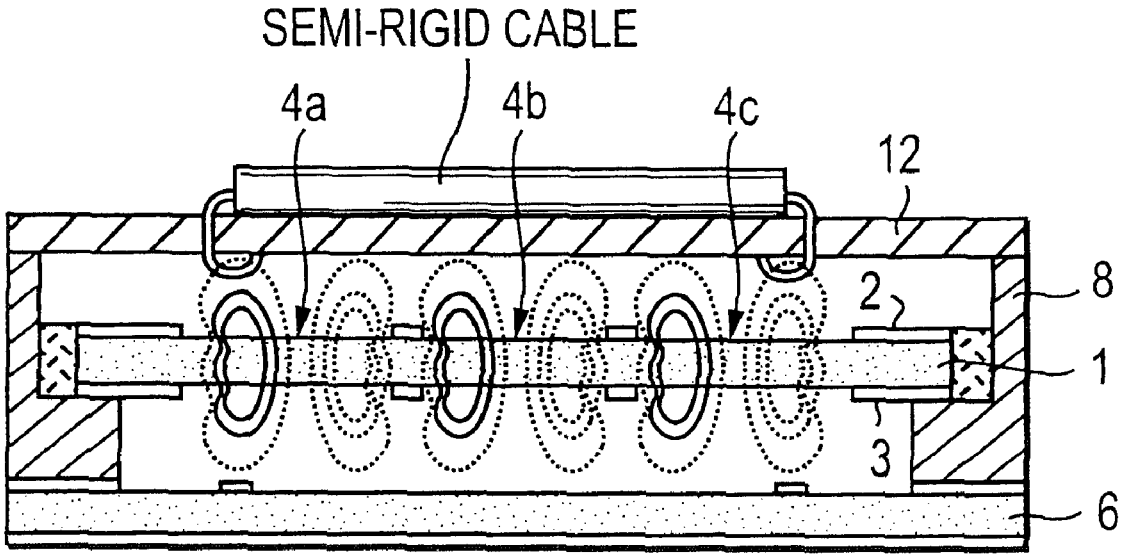
FIG. 20 PRIOR ART
FIG. 20 is a sectional view section of the dielectric filter of FIG. 19.

FIG. 18 is a view illustrating the constitution of a communication device in which the above-mentioned transmission/reception sharing device is used as an antenna multicoupler (duplexer), where 46*a* denotes the above-mentioned reception filter, 46*b* denotes the above-mentioned transmission filter, and 46 denotes an antenna multicoupler. As illustrated in the figure, a reception circuit 47 is connected to a reception signal output port 46*c* of the antenna multicoupler 46, and a power source circuit 48 is connected to a transmission signal input port 46*d,* respectively, and an antenna 49 is connected to an antenna port 46*e* to constitute a transmitter 50 as a whole.

The dielectric filter of the present invention can be provided on a high-frequency circuit part of a communication device, not limited to the antenna multicoupler, and a communication device which is miniaturized and weight-reduced can be provided taking advantage of the characteristics of being compact in size, low in loss and excellent in selectivity.

The present invention, carried out as described above, provides the following advantages.

Because a coupling line for polarization is provided on a substrate, no parts such as a semi-rigid cable are projected outside, preventing the increase in size, and any dead space when mounted in communications equipment. Because the dimensional accuracy of the coupling line for polarization can be easily increased, the characteristic variance is small, and the desired characteristic can be obtained with excellent reproducibility.

Because no special substrate is necessary to provide the coupling line for polarization other than a substrate on which a line for signal input/output is provided, not only is the size of the equipment not increased, but also no special manufacturing process to form the coupling line for polarization is necessary, and the manufacturing cost is not increased.

The substrate provided with the coupling line for polarization can be used as a shield cover, and any member of a shield cover single body can be dispensed with in this structure, and the shield cover can be constituted by a small number of parts.

A substrate for forming the coupling line for polarization can be dispensed with, the number of parts can be reduced, and no special processes for forming the coupling line for polarization are needed for providing a coupling line for polarization on a dielectric plate where a resonator is provided.

A transmission/reception sharing device and a communication device which are more miniaturized and weight-reduced can be obtained taking advantage of the characteristic of being compact in size, low in loss and excellent in selectivity.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric filter comprising:

a dielectric plate;

electrodes having openings of approximately a same shape opposite to each other, on opposite sides of the dielectric plate, provided on both sides of said dielectric plate; and areas of said dielectric plate between said openings constituting respective resonators, wherein a plurality of stages of resonators in which adjacent resonators are successively coupled with each other, are provided on said dielectric plate, and a coupling line for polarization which directly couples two resonators which are separated from each other by one or more other stages among said plurality of said resonators to jump-couple both resonators with each other, is provided on a substrate which is spaced away from said dielectric plate;

further comprising:

a pair of lines for signal input/output disposed on a substrate which is spaced away from said dielectric plate, said pair of input/output lines being coupled respectively with two corresponding resonators of said plurality of said dielectric resonators to input/output a signal;

wherein said coupling line and said input/output lines are provided on different respective substrates which are spaced away from said dielectric plate in opposite directions.

2. A dielectric filter according to claim 1, further comprising a shield cover electrode approximately over the whole area of a surface of said substrate opposite to a surface on which said coupling line for polarization is formed.

3. A transmission/reception sharing device comprising a transmission filter and a reception filter, at least one of said transmission filter and reception filter comprising a dielectric filter, said dielectric filter comprising:

a dielectric plate;

electrodes having openings of approximately a same shape opposite to each other, on opposite sides of the dielectric plate, provided on both sides of said dielectric plate; and areas of said dielectric plate between said openings constituting respective resonators, wherein a plurality of stages of resonators in which adjacent resonators are successively coupled with each other, are provided on said dielectric plate, and a coupling line for polarization which directly couples two resonators which are separated from each other by one or more other stages among said plurality of said resonators to jump-couple both resonators with each other, is provided on a substrate which is spaced away from said dielectric plate;

further comprising:

a pair of lines for signal input/output disposed on a substrate which is spaced away from said dielectric plate, said pair of input/output lines being coupled respectively with two corresponding resonators of said plurality of said dielectric resonators to input/output a signal;

wherein said coupling line and said input/output lines are provided on different respective substrates which are spaced away from said dielectric plate in opposite directions.

4. A transmission/reception sharing device according to claim 3, further comprising a shield cover electrode approximately over the whole area of a surface of said substrate opposite to a surface on which said coupling line for polarization is formed.

5. A communication device comprising:

a transmission circuit and a reception circuit, at least one of said transmission circuit and reception circuit being connected to a dielectric filter, said dielectric filter comprising:

a dielectric plate;

electrodes having openings of approximately a same shape opposite to each other, on opposite sides of the dielectric plate, provided on both sides of said dielectric plate; and areas of said dielectric plate between said openings constituting respective resonators, wherein a plurality of stages of resonators in which adjacent resonators are successively coupled with each other, are provided on said dielectric plate, and a coupling line for polarization which directly couples two resonators which are separated from each other by one or more other stages among said plurality of said resonators to jump-couple both resonators with each other, is provided on a substrate which is spaced away from said dielectric plate;

further comprising:

a pair of lines for signal input/output disposed on a substrate which is spaced away from said dielectric plate, said pair of input/output lines being coupled respectively with two corresponding resonators of said plurality of said dielectric resonators to input/output a signal;

wherein said coupling line and said input/output lines are provided on different respective substrates which are spaced away from said dielectric plate in opposite directions.

6. A communication device according to claim 5, further comprising a shield cover electrode approximately over the whole area of a surface of said substrate opposite to a surface on which said coupling line for polarization is formed.

7. A communication device comprising:

a transmission circuit and a reception circuit;

a transmission/reception sharing device comprising a transmission filter and a reception filter, at least one of said transmission filter and reception filter comprising a dielectric filter, said dielectric filter comprising:

a dielectric plate;

electrodes having openings of approximately a same shape opposite to each other, on opposite sides of the dielectric plate, provided on both sides of said dielectric plate; and areas of said dielectric plate between said openings constituting respective resonators, wherein a plurality of stages of resonators in which adjacent resonators are successively coupled with each other, are provided on said dielectric plate, and a coupling line for polarization which directly couples two resonators which are separated from each other by one or more other stages among said plurality of said resonators to jump-couple both resonators with each other, is provided on a substrate which is spaced away from said dielectric plate;

further comprising:

a pair of lines for signal input/output being disposed on a substrate which is spaced away from said dielectric plate, said pair of input/output lines being coupled respectively with two corresponding resonators of said plurality of said dielectric resonators to input/output a signal, wherein said coupling line and said input/output lines are provided on different respective substrates which are spaced away from said dielectric plate in opposite directions.

8. A communication device according to claim 7, further comprising a shield cover electrode approximately over the whole area of a surface of said substrate opposite to a surface on which said coupling line for polarization is formed.

* * * * *